United States Patent [19]

Brouwer et al.

[11] Patent Number: 4,471,817

[45] Date of Patent: Sep. 18, 1984

[54] FLUID WEFT INSERTION LOOM MONITORING SYSTEM

[75] Inventors: Charles W. Brouwer, East Greenwich, R.I.; Larry C. Cowan, York, S.C.

[73] Assignee: Leesona Corporation, Warwick, R.I.

[21] Appl. No.: 436,462

[22] Filed: Oct. 25, 1982

Related U.S. Application Data

[62] Division of Ser. No. 223,203, Jan. 7, 1981, Pat. No. 4,362,189.

[51] Int. Cl.[3] ..... D03D 47/00

[52] U.S. Cl. ..... 139/429; 139/450; 139/370.2; 139/452

[58] Field of Search ..... 139/429, 450, 336.6, 139/341, 344, 349, 370.1, 370.2, 372, 43 T, 450; 340/259; 66/163

[56] References Cited

U.S. PATENT DOCUMENTS

| | | | |
|---|---|---|---|
| 3,440,634 | 4/1969 | Maurmann et al. | 139/370.2 |
| 3,880,198 | 4/1975 | Vermeuler | 139/370.2 |
| 4,228,828 | 10/1980 | Loepfe et al. | 139/370.2 |
| 4,313,472 | 2/1982 | Weidmann | 139/370.2 |
| 4,359,068 | 11/1982 | Loepfe et al. | 139/370.2 |
| 4,384,596 | 5/1983 | Brouwer et al. | 139/370.2 |
| 4,415,008 | 11/1983 | Keller et al. | 139/370.2 |

*Primary Examiner*—Henry S. Jaudon
*Attorney, Agent, or Firm*—Burnett W. Norton

[57] ABSTRACT

A monitoring unit for a fluid weft insertion loom monitors the yarn supply withdrawal.

6 Claims, 7 Drawing Figures

FIG. 2.
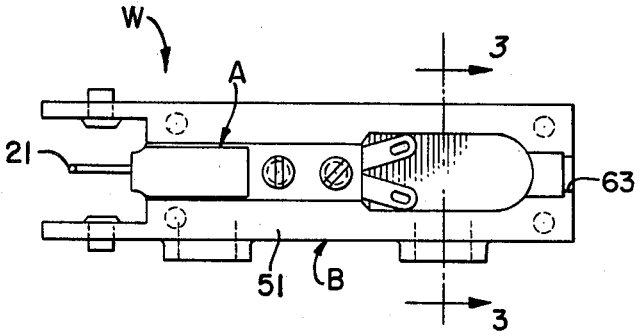
FIG. 3.
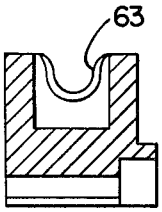
FIG. 4.
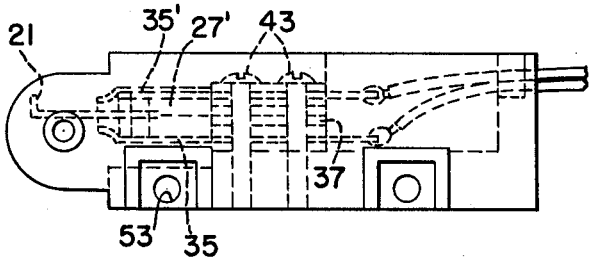
FIG. 5.
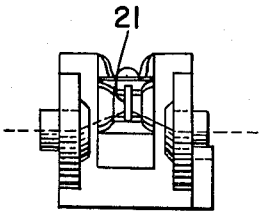
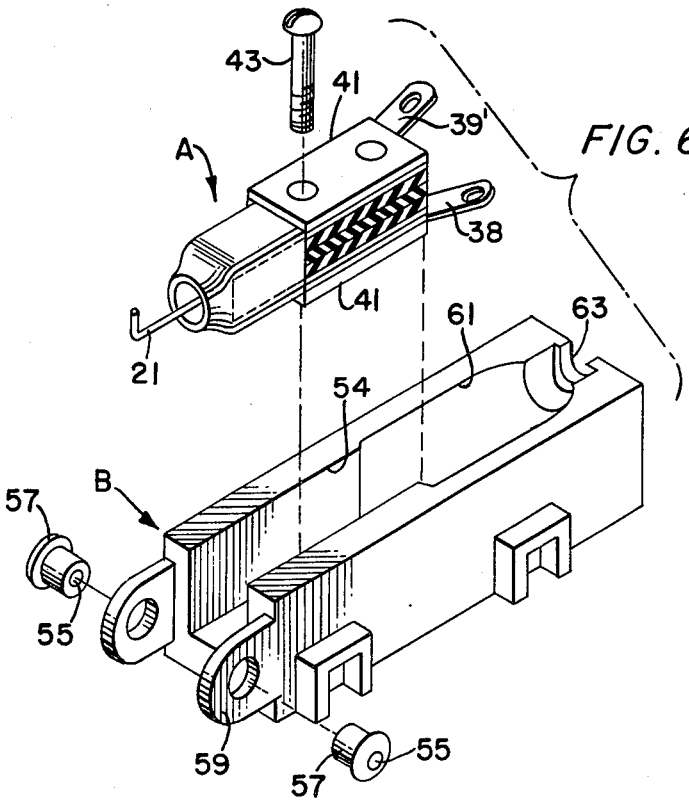
FIG. 6.

FLUID WEFT INSERTION LOOM MONITORING SYSTEM

CROSS-REFERENCE TO RELATED APPLICATIONS

This application is a division of co-pending application Ser. No. 223,203 filed Jan. 7, 1981 now U.S. Pat. No. 4,362,189.

FIELD OF THE INVENTION

This invention relates to the field of fluid weft insertion looms and is concerned more particularly with a monitorying unit for monitoring the withdrawal of yarn from a yarn supply for insertion in the warp of the loom.

BACKGROUND OF THE INVENTION

In a constant search for increased production, the textile industry in very recent times has heavily focussed on the use of looms for weaving fabric in which the filling or weft yarn is inserted by means of a flowing stream of a pressurized fluid, such as air or water. Such looms eliminate the necessity for a mechanical shuttle as the vehicle for projecting the weft yarn during weaving together with the mechanical driving mechanisms necessitated by a shuttle, and consequently offer inherent advantages from the standpoint of increased operation, simplified mechanical construction, and decreased operating noise, all of which are significantly desirable.

In a conventional shuttle operated loom, all of its elements are mechanically interrelated to the operation of a crankshaft and, consequently, the synchronization of the timing of the various significant events which transpire during each weaving cycle can be readily coordinated and adjusted relative to the rotation of the crankshaft. In a loom where the filling is propelled by a pressurized fluid stream, however, all of the significant operating events need no longer be directly related to crankshaft rotation and consequently it becomes more difficult to insure that the timing of these events is brought into the precise synchronism required for high speed operation.

Furthermore, where some of the instrumentalities employed in fluid weft insertion looms are operating independently of the crankshaft, when defective operation does occur, as will necessarily happen occasionally, it is considrably more difficult to trace the cause of a particular defective pick than was the case with conventional mechanically engineered looms.

OBJECTS OF THE INVENTION

The ultimate object of the present invention is to provide a monitoring unit for detecting the movement of withdrawal of a generally predetermined length of yarn from a yarn supply and to provide an indication of such detection and to indicate by the absence of such detection, the failure of such withdrawal to occur.

GENERAL DESCRIPTION OF THE INVENTION

In accordance with the present invention, a loom of the type where the weft yarn is projected across its shed by means of a pressurized fluid stream emitted from a projection nozzle is equipped with a monitoring unit for observing the occurred during each cycle of operation of the withdrawan during yarn projection of a generally predetermined length from an accumulated supply of yarn which is cyclically replenished.

A preferred context for the execution of the present monitoring system is the particular fluid weft insertion loom disclosed in a related application Ser. No. 64,180, filed on Aug. 6, 1979 in the name of Charles W. Brouwer et al and commonly assigned herewith. This application discloses an improved operating loom of the type in question including a yarn storage unit wherein a predetermined length of yarn corresponding to the length to be inserted is metered out from a supply and collected in a storage zone, e.g. wound on a rotating drum, while a downstream end of the yarn reposes within the throat of an injection nozzle, being gripped by a positively acting clamp in the intervening region until just prior to the yarn insertion stage, at which point a pressurized fluid, in this case air or other compressible gas, is delivered virtually instantaneously to the nozzle throat for contact with the yarn reposed therein, the energy contained within the pressurized fluid emitted from the nozzle throat being sufficient to engage the yarn leading end and propel the same across the width of the loom through the shed of the warp threads being consecutively opened and closed in the usual manner of a loom, for eventual receipt at the opposite shed side within a suction tube wherein the yarn end remains until the weaving cycle is completed by the beat up of the newly inserted weft against the fell of the fabric being woven, at which time the exteriorly projecting ends of the beat up weft are sheared by means of shears. While the monitoring unit of the present invention is especially suitable for association with the loom described in the above identified application, and has been designed with this in mind, the present invention is not mainly limited in its applicability to that particular loom, or even looms using a compressible gas as the weft propelling medium, but, indeed, will be of equal utility with looms utilizing a noncompressible liquid, such as water, as the propelling medium.

BRIEF DESCRIPTION OF THE DRAWINGS

FIGS. 2–7 are detailed views of the yarn withdrawal or delivery sensing unit in which:

FIG. 2 is a top plan view of the sensing unit associated with its housing bracket;

FIG. 3 is a transverse cross-sectional view of the housing bracket taken generally along lines 3—3 of FIG. 2;

FIG. 4 is a right side elevation of the assembly of FIG. 2;

FIG. 5 is a front end elevation of the assembly of FIGS. 2 and 4 with the path of the yarn therethrough being indicated by a broken line;

FIG. 6 is an exploded view of the sensing unit and housing of FIGS. 2 and 4; and FIG. 7 is an exploded view of the sensing unit itself, omitting the laminated insulation spacer.

DETAILED DESCRIPTION OF THE INVENTION

Overall System

Figure 1:
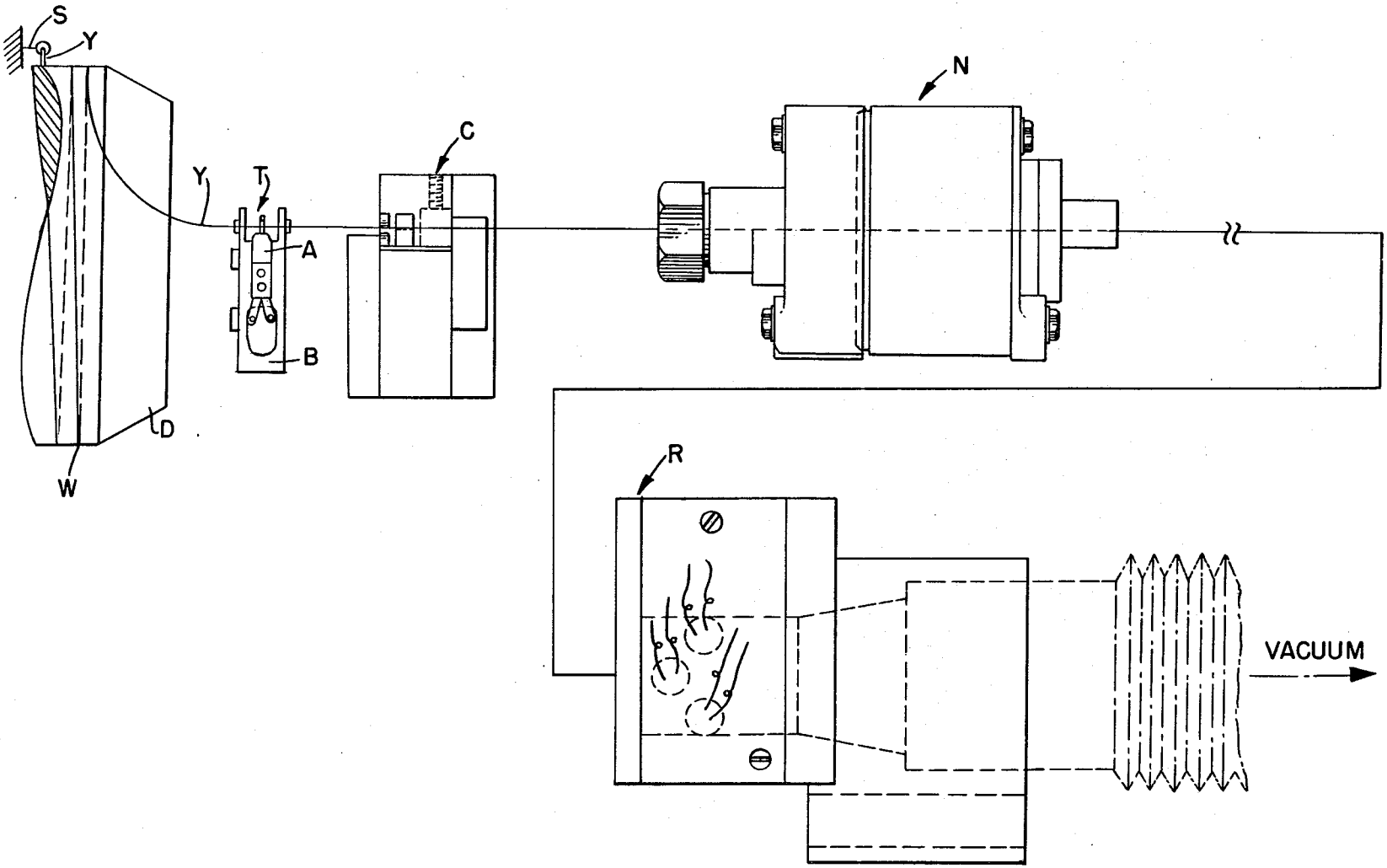
FIG. 1 is a side elevational view, somewhat idealistic, showing the main components of a fluid weft insertion loom which have some operative connection with the unit of the invention, all of the working parts of the loom, however, including the warp and the various supporting members for the components depicted being omitted for sake of clarity, except as needed for an adequate understanding of such relation.

An overall view of the arrangement of the main components of a fluid weft insertion loom forming the context for the monitoring system of the present invention appears in FIG. 1 wherein those components of the loom which have no material relation to the present invention have been omitted for sake of clarity. Thus, all of the interior loom components which form and define the shed, etc., do not appear in FIG. 1, which is broken away to suggest this absence. FIG. 1 does show the end of the yarn metering and storage unit which functions to meter out the appropriate length of yarn according to the width of the loom in question, and store the same in readiness for delivery to the insertion nozzle when needed. The yarn metering and storage unit is the same as disclosed in the above identified related application, Ser. No. 64,180, and for further details of its structure and operation, reference may be had to the disclosure of that application.

As shown in FIG. 1, the yarn Y is delivered from a supply source not shown through a fixed yarn stop in the form, for example, of a guide aperture S, onto the surface of a storage drum D where it is collected into coils or windings W. From the coils W, the yarn passes through the yarn withdrawal or delivery monitoring unit of the invention generally designated T capable of detecting a sudden rise in yarn operating tension incidental to complete withdrawal of the stored yarn supply from storage drum D, a solenoid-actuated yarn clamp generally designated C, which positively grips and holds the yarn during its accumulation on the storage drum and then releases the yarn preparatory to the weft insertion phase of the cycle, a weft insertion nozzle generally designated N which when actuated emits a blast of pressurized air through the throat thereof, and a yarn reception unit generally designated R which includes a suction tube for aspirating the leading yarn end therein.

Improved Yarn Delivery Sensor

A preferred embodiment of the improved yarn delivery sensor unit of of the invention will now be described in detail.

Figure 7:
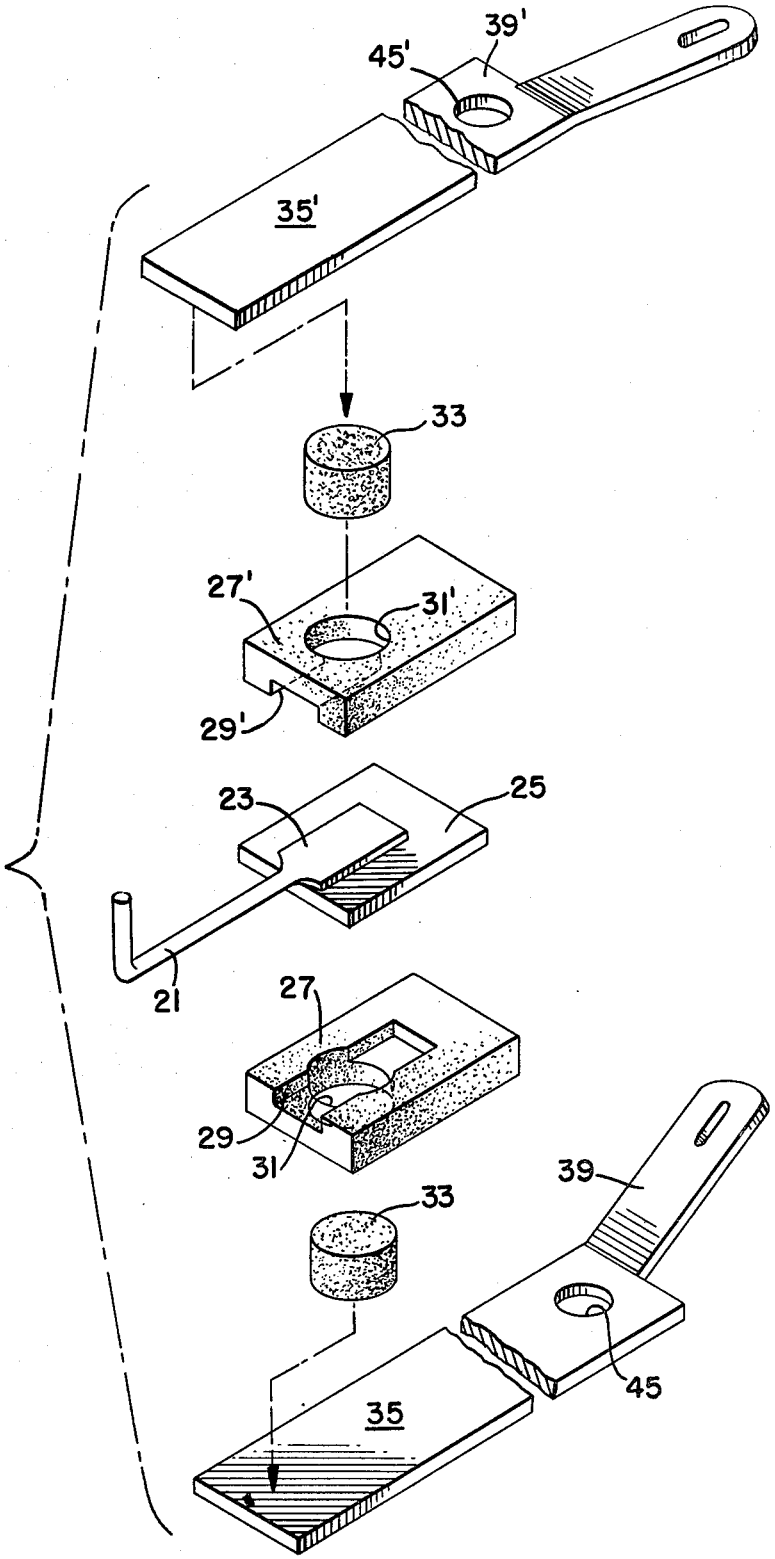

This improved yarn withdrawal or delivery sensing unit W is adapted to be disposed in a position to be responsive to significant increase in yarn tension as a consequence of complete withdrawal of a prepared supply of yarn during delivery and is illustrated in FIGS. 2 through 7. It consists of a sensing assembly A and a supporting bracket B. As best seen in FIG. 7, the active element of the sensing assembly A takes the form of an L-shaped or hook-shaped yarn engaging finger 21 which has a flattened base end 23 which is secured, as by soldering, to one surface of a flat wafer-like "bimorph" crystal 25. Such crystals are commercially available, and, as is well known, are constructed of two thinplates or layers of piezoelectric material which has the characteristic of emitting an electrical voltage in response to the application thereto of mechanical stress. These two crystal plates are cemented together in such a way that when the crystal laminate is deflected by the application of mechanical force in a direction perpendicular to the starting plane thereof, the crystal laminate emits a momentary electrical voltage with a positive polarity and when the crystal returns to its original condition upon the removal of the applied mechanical force, it emits an electrical voltage of negative polarity. One commercial source of such crystals is Vernitron Piezoelectric Division, 232 Forbes Road, Bedford, Ohio, under the identification of catalog number 60873. The crystal 25 employed here is of generally square configuration, although other configurations are equally suitable, and the margins of the crystal are gripped between two opposed nonconductive holders 27,27' formed of neoprene or like insulating material, which are grooved on their respective adjacent faces toward the piezoelectric crystal with shallow recesses 29,29' so as to facilitate deflection of the crystal when a mechanical load is applied to finger 21. To create an electrically conductive path to each side of the thus supported crystal 25 an aperture is formed in each of the insulating pressure pads as at 31, 31' and a plug 33, 33' of a conductive compressible form is inserted into each such aperture. The composite of the pads, plus, crystal, and finger is inserted with a pressure fit between the elongated flat electrically conductive fingers 35, 35' which are hend in spaced apart electrically isolated relationship by a laminated block of nonconductive material 37 (omitted in FIG. 7, seen in FIGS. 4 and 6). The metallic fingers project exteriorly of the opposite end of the laminated stack at diverging angles as at 39, 39' (see FIG. 6) to form readily accessible terminals for the connection thereto of appropriate electrical wiring. The assembly A is completed by insulating cover plates 41, 41' and held together by bolts 43, the apertures therefor in metal fingers, as at 45, 45', being oversize to prevent electrical contact therewith, and the bolts 43 can anchor the assembly in its supporting bracket B. To shield the active end of assembly A, a sleeve 47 of heat-shrinkable material is placed over the projecting end of the assembly and shrunk therearound as seen in FIG. 6.

The sensing assembly just described can, of course, be mounted in a variety of different ways but a useful supporting bracket B therefor has been designed and is illustrated in FIGS. 2 through 6. This bracket consists of a generally channel-shaped body 51 having apertures in its base as at 53 for easy attachment to a fixed part of the loom or other supporting surface. The sensing assembly A just described fits in the forward end of the channel 54 (see FIG. 6) of the housing, which end is open for that purpose, being held in place by the screws 43 in threaded engagement at their lower ends with threaded openings furnished for that purpose in the base of the housing. In this position, the sensing finger 21 itself projects exteriorly of the open end of the body 51 and aligned guide apertures 55 are formed in wear-resistant inserts 57 inserted in ears 59 projecting forwardly from the front side walls of the housing. These apertures are coaxial and are displaced to one side of the working level of the yarn engaging finger 21, their common axis being in the illustrated arrangement disposed below finger 21, so that yarn passing through guide apertures 55 and over the finger 21 is deflected by the finger into an at least slightly sinuous path. Thus, if tension is imposed upon the yarn, that tension works to stretch the yarn out of that sinuous path and thereby applies a mechanical force against the yarn sensing finger. Clearly, the relationship of the yarn engaging finger and the guide apertures is subject to variation from that shown while still achieving the intended functional result and the particular orientation of the drawings if not intended to be critical.

The remainder of the channel 54 in the housing is enlarged as at 61 so as to accomodate the electrical terminals 39, 39' of the assembly A as well as the wires connected thereto and while the rear end of the channel could be open similar to its front, it is preferably closed except for a semicircular passage 63 to permit the electrical leads to easily exit from the interior of the channel, as shown in dotted lines in FIG. 4.

The mechanical force applied against the yarn sensing finger 21 when a condition of tension occurs in the yarn, due to the laterally displaced disposition of finger 21 from the common axis of yarn guide apertures 55 is transmitted through the flattened base end 23 of finger 21 to the flat bimorph crystal 25 and causes the latter to underto a deflection in a direction perpendicular to its starting plane due to the cantilevered projection of finger 21 forwardly of the limits of the crystal. This deflection of the bimorph crystal results in the generation of an electrical voltage across the crystal which appears in the respective conductive fingers 35, 35' and on any electrical leads connected thereto as indicated in FIG. 4 of the drawings, and this voltage signal thus serves as an indication of the occurrence of a tensioned condition in the yarn. The arrangement of the invention, therefore, constitutes a simple and reliable way of determining the occurrence of temporary increases in tension in a moving strand of yarn which is highly reliable and effective.

What is claimed is:

1. In combination with a loom wherein a predetermined length of weft yarn to be inserted into the shed of a loom having a width generally equal to said predetermined weft yarn length is collected into a supply disposed on one side of said shed and is propelled by propulsion means in a path from said one shed side across the shed to the other shed side, the improvement comprising, a weft yarn sensor interposed in said weft yarn path, said sensor including a weft yarn engaging element responsive to the removal of said predetermined length of weft yarn from said collected supply and electrical generating means connected with said element to thereby produce an electrical output pulse indicative of weft depletion from the accumulated supply.

2. The combination of claim 1 wherein said weft yarn is fed from a yarn source for collection into said supply and means is provided at said supply for temporarily restraining said weft yarn against further withdrawal from said collected supply after withdrawal of said predetermined length therefrom by said propulsion means whereby withdrawal of said predetermined length of yarn results in a momentary significant increase in the tension in said withdrawn length, and said yarn engaging element is responsive to said tension increase.

3. The combination as set forth in claim 1 including event display means operative in response to said output signal to provide a readout indicating weft depletion from said accumulated supply.

4. The combination as set forth in claim 1 including guide means for directing said weft yarn into engagement with said weft yarn engaging element as said weft yarn is propelled in said path.

5. The combination as set forth in claim 1 including filter means for precluding production of output signals in response to spurious pulses from said electrical generating means preliminary to depletion of said weft yarn from said accumulated supply.

6. The combination as set forth in claim 1 including a weft yarn reception unit positioned at said opposite side of said shed, and including means for stopping operation of said loom in the event said weft yarn is not received at said reception unit.

* * * * *